US007990343B2

(12) United States Patent
Takahashi

(10) Patent No.: US 7,990,343 B2
(45) Date of Patent: Aug. 2, 2011

(54) FALSE CONTOUR REDUCTION DEVICE, DISPLAY DEVICE, FALSE CONTOUR REDUCTION METHOD, AND FALSE CONTOUR REDUCTION PROGRAM

(75) Inventor: Yasunori Takahashi, Izumi (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 1042 days.

(21) Appl. No.: 11/130,398

(22) Filed: May 17, 2005

(65) Prior Publication Data

US 2005/0265628 A1 Dec. 1, 2005

(30) Foreign Application Priority Data

May 18, 2004 (JP) ..... 2004-148114

(51) Int. Cl.
*G09G 3/28* (2006.01)

(52) U.S. Cl. ..... 345/63

(58) Field of Classification Search ..... 345/60–72, 345/589–605; 382/275
See application file for complete search history.

(56) References Cited

U.S. PATENT DOCUMENTS

| | | | | |
|---|---|---|---|---|
| 6,340,961 | B1 * | 1/2002 | Tanaka et al. | 345/63 |
| 6,661,469 | B1 * | 12/2003 | Kawabata et al. | 348/607 |
| 7,180,480 | B2 * | 2/2007 | Lee et al. | 345/60 |
| 2004/0080517 | A1 * | 4/2004 | Song et al. | 345/596 |

FOREIGN PATENT DOCUMENTS

| | | | |
|---|---|---|---|
| JP | 11-85101 | | 3/1999 |
| JP | 2004-126591 | | 4/2004 |
| KR | 2003-0001770 | * | 1/2003 |
| KR | 2003-0003869 | | 1/2003 |

OTHER PUBLICATIONS

Hiraki Uchiike, et al., "All About Plasma Display", Kabushiki Kaisha Kogyo Chosakai, May 1, 1997, pp. 164-165.

* cited by examiner

*Primary Examiner* — Sumati Lefkowitz
*Assistant Examiner* — Robert E Carter, III
(74) *Attorney, Agent, or Firm* — McGinn IP Law Group, PLLC

(57) ABSTRACT

A false contour reduction device reduces the occurrence of false contours on a display screen. The false contour reduction device includes a false contour occurrence pixel detection circuit, a specific color pixel detection circuit, and a false contour reduction processing circuit. The false contour occurrence pixel detection circuit detect at which pixels false contours will occur among the pixels in an image based on the input image signal. The detected pixels are false-contour-occurring pixels. The specific color pixel detection circuit detects pixels which have a specific color within a specific color range, among the false-contour-occurring pixels. The detected pixels are specific color false-contour-occurring pixels. The false contour reduction processing circuit performs a false contour reducing process on the specific color false-contour-occurring pixels.

29 Claims, 12 Drawing Sheets

FIG. 2

| GRADATION LEVEL | 1ST | 2ND | 3RD | 4TH | 5TH | 6TH | 7TH | 8TH | SUBFIELD NUMBER |
|---|---|---|---|---|---|---|---|---|---|
| | 1 | 2 | 4 | 8 | 16 | 32 | 64 | 128 | EMISSION BRIGHTNESS RATIO |
| 0 | | | | | | | | | |
| 1 | ○ | | | | | | | | |
| 2 | | ○ | | | | | | | |
| 3 | ○ | ○ | | | | | | | |
| 4 | | | ○ | | | | | | |
| ⋮ | | | | | | | | | |
| 126 | | ○ | ○ | ○ | ○ | ○ | ○ | | |
| 127 | ○ | ○ | ○ | ○ | ○ | ○ | ○ | | |
| 128 | | | | | | | | ○ | |
| 129 | ○ | | | | | | | ○ | |
| ⋮ | | | | | | | | | |
| 254 | | ○ | ○ | ○ | ○ | ○ | ○ | ○ | |
| 255 | ○ | ○ | ○ | ○ | ○ | ○ | ○ | ○ | |

SUBFIELDS DENOTED BY CIRCLES ARE LIT

FALSE CONTOUR REDUCTION DEVICE, DISPLAY DEVICE, FALSE CONTOUR REDUCTION METHOD, AND FALSE CONTOUR REDUCTION PROGRAM

BACKGROUND OF THE INVENTION

1. Field of the Invention

This invention relates to a false contour reduction device, display device, false contour reduction method, and false contour reduction program.

2. Description of the Related Art

A display device receives an input image signal and displays an image in pixel units. As shown in FIG. 12A of the accompanying drawings, a display device sequentially scans the pixels in the following order: pixel Pi−4→pixel Pi−3→pixel Pi−2→pixel Pi−1→pixel Pi→pixel Pi+1→pixel Pi+2→pixel Pi+3, to display the image.

The display device expands an input image signal into a time series of subfields having different gradation levels (with different brightness weightings), that is, into a plurality of subfields with different emission durations, and selects a combination of light-emitting subfields within a single field of image according to the intended gradation, so that the display device can perform appropriate gradation representation of each pixel.

In FIG. 12A, one field is divided into eight subfields, from the first subfield to the eighth subfield.

When the display device displays a moving image, or when the display device displays a still image but an observer moves his line of vision as indicated by the arrow in FIG. 12A, unexpected gradation changes are perceived, as indicated in FIG. 12B. That is, false contours are observed.

This is because emission in each subfield is performed in order in a time series and therefore the image of each subfield is perceived as an afterimage by an observer, undifferentiated from the subfields of adjacent gradations in the time series and from the subfields of the next image field.

Such false contours occur especially prominently in places where the weighting of the subfields changes significantly.

An explanation of false contours is given in, for example, a book entitled "All About Plasma Display" Hiraki Uchiike and Shigeo Mikoshiba, Kabushiki Kaisha Kogyo Chosakai, May 1, 1997, pp. 164-165.

At places where false contours occur, the observer does not perceive the gradations originally intended. In the case of grayscales, the observer perceives this as gradation inversion. In the case of color display, the observer perceives completely different colors. Hence an image is experienced which is markedly degraded compared with the input image.

Thus, it is essential that false contours be reduced in display devices such as plasma displays which employ a subfield emission scheme for gradation representation.

SUMMARY OF THE INVENTION

One object of the present invention is to reduce a false contour, with minimal degradation of image quality, in a plasma display device or other display device which displays images through subfield driving.

According to one aspect of the present invention, there is provided a false contour reduction device, which reduces an occurrence of a false contour on a display screen of a display device. The false contour reduction device includes a false contour reducing unit for performing a false contour reducing process on a specific color false-contour-generating image signal. The specific color false-contour-generating image signal is an image signal which will generate a false contour and which has a specific color in a certain (or specific) color range among input image signals.

The occurrence of the false contour is reduced because the false contour reducing process is carried out. Thus, deterioration of display qualities is minimized.

In this invention, the false contour reduction process is applied to only those image signals which have colors in a certain color range, among the image signals which will generate false contours. In other words, the false contour reducing process may not be applied to the image signals if the false contours are not noticeable very much. This prevents display quality deterioration due to execution of the false contour reduction process. In different terms, excessive use of the contour reduction process can be avoided.

According to a second aspect of the present invention, there is provided a display device which includes the above described false contour reduction device. The display device also includes a display unit having a display screen to display an image based on the image signals which have undergone the false contour reducing process performed by the false contour reduction device.

According to a third aspect of the present invention, there is provided a method for reducing an occurrence of a false contour on a display screen of a display device. This method includes detecting an image signal which will generate a false contour, among input image signals so as to provide a false-contour-generating image signal. This method also includes detecting a signal which has a specific color in a certain color range, among the false-contour-generating image signal, to provide a specific color false-contour-generating image signal. This method also includes performing a false contour reducing process on the specific color false-contour-generating image signal, so as to reduce the false contour.

According to a fourth aspect of the present invention, there is provided another method for reducing an occurrence of a false contour on a display screen of a display device. This method includes detecting an image signal which will generate a false contour, among input image signals to provide a false-contour-generating image signal. This method also includes detecting an image signal which has a color in a certain color range, among the input image signals. The detected image signal is called a specific color image signal. This method also includes performing a false contour reducing process on a specific color false-contour-generating image signal, so as to reduce the false contour. The specific color false-contour-generating image signal is an image signal which qualifies for both the false-contour-generating image signal and the specific color image signal.

According to a fifth aspect of the present invention, there is provided another method for reducing an occurrence of a false contour on a display screen of a display device. This method includes detecting an image signal which has a color in a certain color range, among input image signals. The detected image signal is called a specific color image signal. This method also includes detecting a signal which will generate a false contour, among the specific color image signal to provide a specific color false-contour-generating image signal. This method also includes performing a false contour reducing process on the specific color false-contour-generating image signal, so as to reduce the false contour.

According to a sixth aspect of the present invention, there is provided a program for causing a computer to perform a false contour reducing process carried out by the false contour reduction device.

BRIEF DESCRIPTION OF THE DRAWINGS

FIG. 2 shows an example of the relation between the gradation levels of a pixel and the lit states of subfields;

DETAILED DESCRIPTION OF THE INVENTION

Below, embodiments of the invention will be described with reference to the accompanying drawings.

First Embodiment

Figure 1:
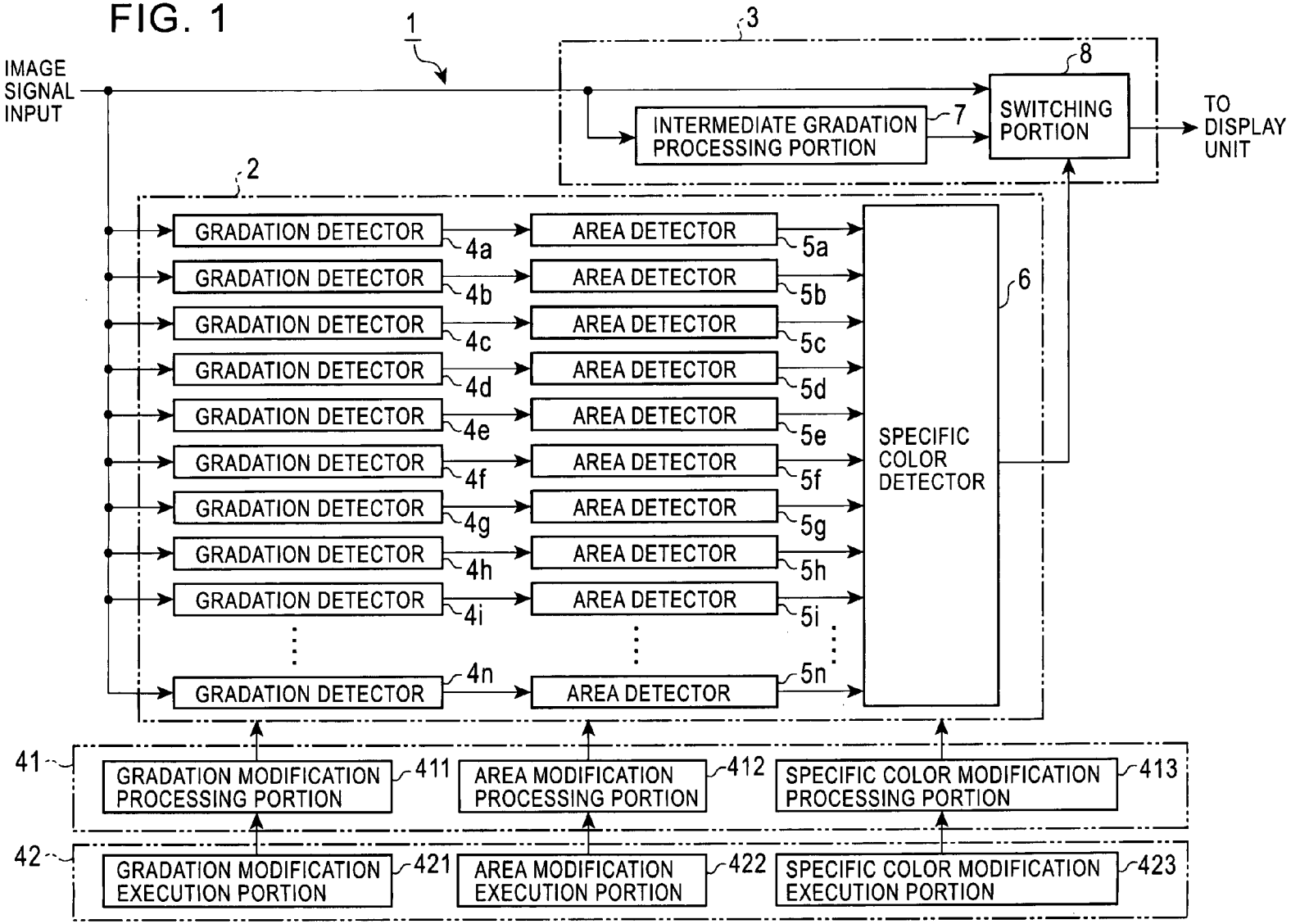
FIG. 1 is a block diagram of a false contour reduction circuit according to a first embodiment of the present invention.

Referring to FIG. 1, a structure of a false contour reduction circuit (false contour reduction device) 1 of a first embodiment will be described.

As shown in FIG. 1, the false contour reduction circuit 1 includes a determination portion 2 to determine or predict pixels at which false contours occur among those pixels having a certain (or specific) range of color in an image, based on an input image signal introduced to the false contour reduction circuit 1. Such pixels are referred to as "false-contour-generating (or occurring) pixels." The determination portion 2 finds an image signal which has a certain color and which will generate a false contour. The false contour reduction circuit 1 also includes a false contour reducing portion 3, which performs false contour reduction processing on the image signal used in the display of the false-contour-generating pixels determined by the false contour occurrence pixel determination portion 2. The false contour reduction circuit 1 also includes a setting modification unit 41, which performs processing to modify the settings for the false-contour-generating pixels, and a setting modification execution unit 42, which causes the setting modification unit 41 to execute the setting modification processing.

The determination unit 2 has, for example, n (where n is a natural number) gradation detectors 4*a*, 4*b*, 4*c*, 4*d*, 4*e*, 4*f*, 4*g*, 4*h*, 4*i*, . . . , and 4*n*. The gradation detector is a false-contour-generating image signal detector. The determination unit 2 also has n area detectors 5*a*, 5*b*, 5*c*, 5*d*, 5*e*, 5*f*, 5*g*, 5*h*, 5*i*, . . . , and 5*n*. Each of the area detection portions 5*a* to 5*n* is associated one-to-one with each of the gradation detection portions 4*a* to 4*n*. The determination unit 2 also has a single specific color detector 6. The specific color detector 6 is a specific color false-contour-generating image signal detector.

Each of the gradation detectors 4*a* to 4*n* determines that pixels within a prescribed gradation range are candidates for pixels at which false contours may occur (candidate pixels), and supplies only the image signals used in display of the candidate pixels to the associated area detector 5*a* to 5*n*.

In other words, each gradation detector 4*a* to 4*n* detects false-contour-generating image signals in the input image signals and transfers only the false-contour-generating image signals to the area detector 5*a* to 5*n*.

FIG. 2 shows gradation levels together with the lit/unlit states of the subfields when a single field is divided into first through eighth subfields and the emission brightness ratios of the subfields are 1:2:4:8:16:32:64:128. Note that FIG. 2 does not show all the gradation levels.

In FIG. 2, by appropriately combining the lit and unlit subfields, brightnesses can be represented in 256 gradation levels, in order from gradation 0 to gradation 255.

When gradation expression employs the subfield method, the lit/unlit states of the subfields for two adjacent gradations are sometimes substantially inverted even if brightnesses represented by these adjacent gradations are close to each other. In FIG. 2, for example, the lit/unlit states of the subfields for the gradation 127 are substantially inverted when compared with the lit/unlit states of the subfields for the gradation 128.

Thus when pixels with close gradations for which the lit/unlit states in the subfields are substantially or considerably inverted are located adjacent to each other on the display screen, false contours are observed when a viewer moves his line of vision.

Hence in this embodiment, the gradation detection portions 4*a* to 4*n* detect pixels with adjacent gradations (or adjacent brightnesses) across a false-contour-generating border (for example, gradations 127 and 128, gradations 63 and 64, gradations 31 and 32, or gradations 15 and 16), and pixels having gradations near these gradations (for example, the three gradations before and after the gradations 127 and 128, before and after the gradations 63 and 64, before and after the gradations 31 and 32, and before and after the gradations 15 and 16), and take them as pixels with gradations at which false contours will occur. Specifically, the pixels are detected in the gradation ranges from gradation 124 to gradation 131, from gradation 60 to gradation 67, from gradation 28 to gradation 35, from gradation 12 to gradation 19, and similar.

The gradation detection portions 4*a* to 4*n* are allocated to predetermined gradation ranges respectively. Also, each gradation detection portion 4*a* to 4*n* is allocated to a color image signal of each primary color (for example, red, green and blue) used for color display. Further, the gradation detection portions 4*a* to 4*n* are allocated to predetermined target regions on the display screen respectively.

Figure 3:
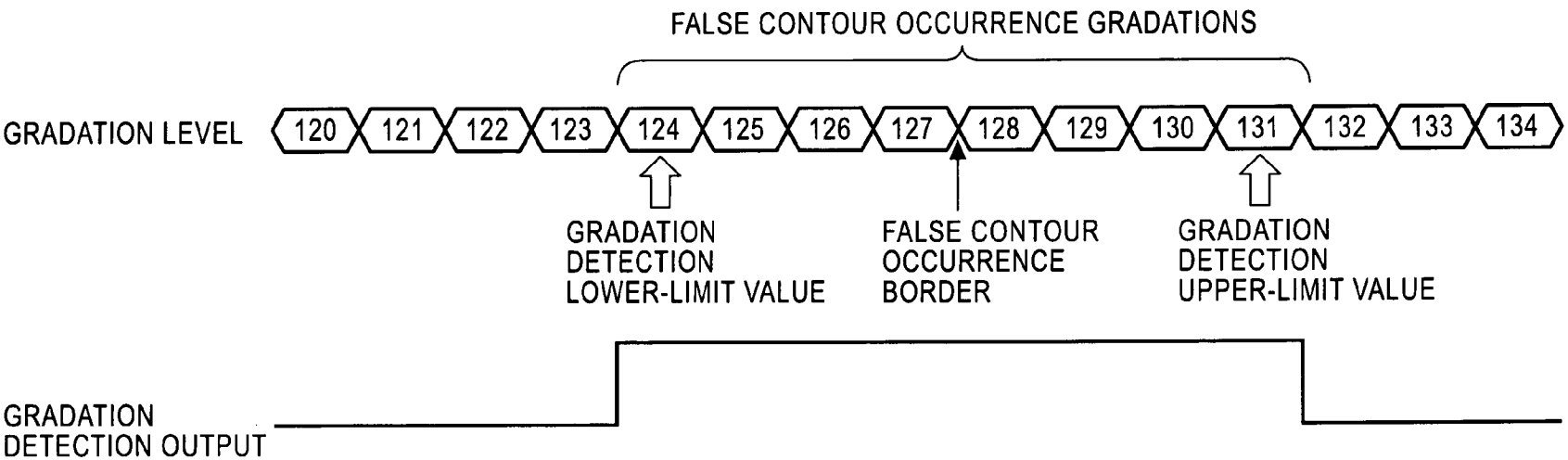
FIG. 3 shows an example of upper-limit and lower-limit settings of the gradation range for determining the occurrence of false contours.

Specifically, the gradation detection portion 4*a*, for example, detects image signals for display of red pixels in a prescribed display region (target region) A (not shown) if the intended image has gradation between gradation 124 and gradation 131, and feeds the detection results to the next stage (area detection portion 5*a*) (see FIG. 3).

Similarly, the gradation detection portion 4*b*, for example, detects image signals used for display of green pixels in the display region A if the intended image has gradation between gradation 124 and gradation 131, and supplies the detected image signals to the area detection portion 5*b*. Likewise, the gradation detection portion 4*c*, for example, detects image signals used in the display of blue pixels in the display region A if the intended image has gradation between gradation 124 and gradation 131, and supplies the detected image signals to the area detection portion 5*c*.

The gradation detection portion 4*d* detects, for example, image signals for display of red pixels in a display region B if the intended image has gradation between gradation 124 and gradation 131. The display region B may be completely separate from the display region A, or may partially overlap the display region A. The gradation detection portion 4*d* supplies the detection result (detected image signals) to the area detection portion 5*d*. The gradation detection portion 4*e* detects image signals for display of green pixels in the display region B if the intended image has gradation between gradation 124 and gradation 131, and supplies the detection result to the area detection portion 5*e*. The gradation detection portion 4*f* detects image signals for display of blue pixels in the display region B if the intended image has gradation between gradation 124 and gradation 131, and supplies the detection result to the area detection portion 5*f*.

In other display regions than the display regions A and B, the gradation detection portions detect pixels in the gradation range from gradation 124 to gradation 131 in the same manner, for each of the red, green, and blue pixel signals. Accordingly, the gradation detection portions operate to detect pixels in the gradation range from gradation 124 to gradation 131 for the entire display screen.

The gradation detection portion 4*g* detects, and supplies to the next stage (area detection portion 5*g*), image signals for display of red pixels in the display region A if the intended image has gradation between gradation 60 and gradation 67.

The gradation detection portion 4*h* detects image signals for display of green pixels in the display region A if the intended image has gradation between gradation 60 to gradation 67, and supplies the detection result to the area detection portion 5*h*. The gradation detection portion 4*i* detects image signals for display of blue pixels in the display region A if the intended image has gradation between gradation 60 and gradation 67, and supplies the detection result to the area detection portion 5*i*.

Similarly, the determination unit 2 has gradation detection portions to detect red, green and blue image signals in each display region for each of the gradation ranges in which false contours occur other than gradation 124 to gradation 131 and gradation 60 to gradation 67. Through concerted operation of these gradation detection portions, the false contour occurrence pixel determination unit 2 can detect pixels in each target gradation range.

Thus each of the gradation detection portions 4*a* to 4*n* transmits image signals as candidate image signals to the associated next-stage (area detection portion 5*a* to 5*n*) only if a color component (red, green or blue) of the image signals has a gradation within the predetermined gradation (specific to the gradation detection portion in question) and its pixel is within the predetermined display region (specific to the gradation detection portion in question).

Hence the false contour occurrence pixel determination unit 2 finds false-contour-generating pixels in a plurality of different gradation ranges, and finds false-contour-generating pixels for each of a plurality of primary colors.

Each of the gradation detection portions 4*a* to 4*n* has a first comparator (not shown) which detects gradations equal to or less than the upper-limit value (for example, gradation 131 in FIG. 3) of a gradation range in which false contours occur, a second comparator (not shown) which detects gradations equal to or greater than the lower-limit value (for example gradation 124 in FIG. 3) of the gradation range, and a logical-product circuit (not shown) which generates the logical product of the outputs of the first and second comparators. By means of the first comparator, second comparator, and logical-product circuit, decisions are made as to whether a pixel is within a false-contour-occurring gradation range.

Each of the area detection portions 5*a* to 5*n* determines whether the candidate pixels decided by the corresponding gradation detection portion 4*a* to 4*n* exist continuously over a display region of a prescribed area. When a pixel exists continuously, the area detection portion 5*a* to 5*n* supplies the candidate pixel to the next-stage (specific color detection portion 6; see FIG. 4).

Specifically, the area detection portions 5*a* to 5*n* determine whether there exist candidate pixels, for example in a three-pixel display region. The three pixels (or more) may continue in the horizontal scanning direction or in the vertical direction of the screen.

Figure 4:
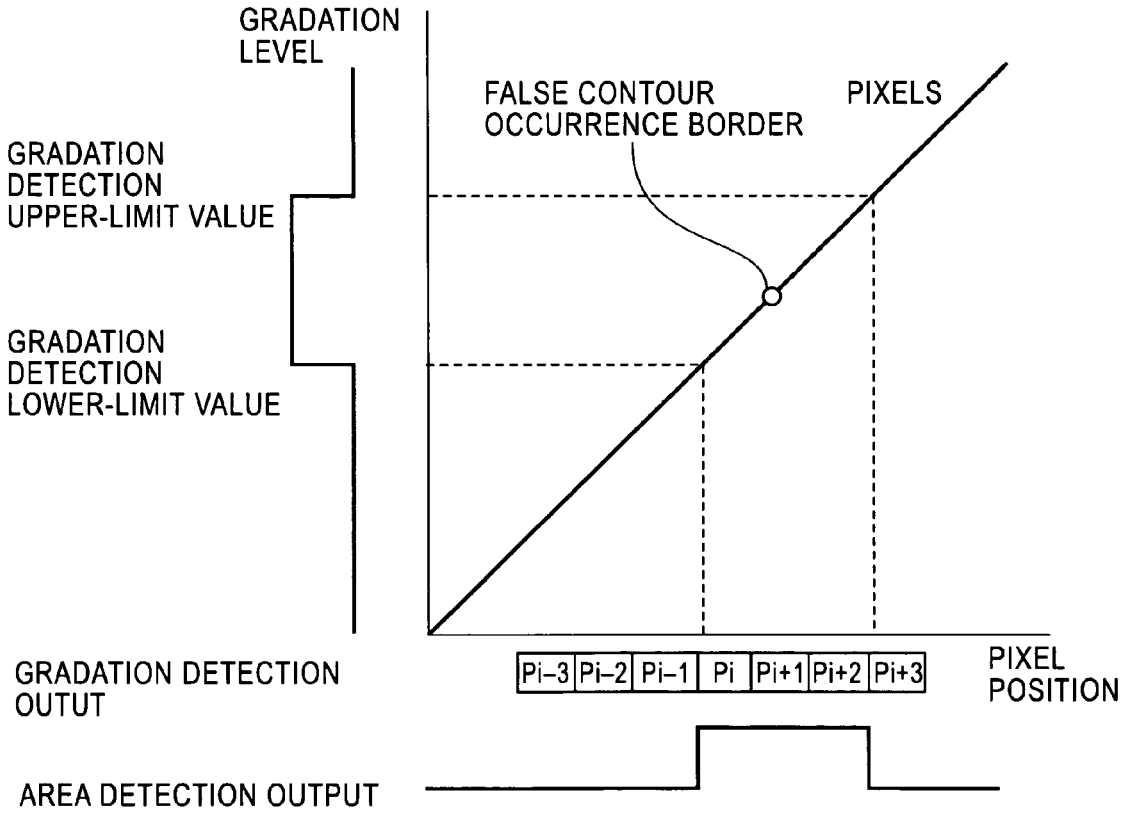
FIG. 4 shows an example of the size of the display region in which occurrence of false contours is predicted.

Hence as shown in FIG. 4, candidate pixels are supplied to the specific color detection portion 6 if the candidate pixels exist over a continuous three-pixel (pixel Pi, pixel Pi+1, and pixel Pi+2) worth of display region in the horizontal scanning direction of the image.

Each of the area detection portions 5*a* to 5*n* includes a counter and logical-product circuit (neither shown) which detect the existence of a continuous prescribed number or greater of candidate pixels in at least either the horizontal direction or the vertical direction of the display. By means of the counter and logical-product circuit, it is determined whether the candidate pixels, found by the corresponding gradation detection portion 4*a* to 4*n*, exist continuously in a display region of prescribed area or greater.

The specific color detection portion 6 supplies to the false contour reduction portion 3 only those candidate pixels, among all the candidate pixels issued from the area detection portions 5*a* to 5*n*, which have gradations of display colors in a specific color range (in other words, a display color for which false contours are prominent). The supplied candidate pixels are called false-contours-occurring pixels. The specific color range is a range in which false contours will possibly occur.

In short, the false-contour-generating image signals are supplied to the specific color detection portion 6 from the area detection portions 5*a* to 5*n*, and those false-contour-generating image signals which exist in the specific color ranges are detected by the specific color detection portion 6. The detected false-contour-generating image signals (i.e., specific-color false-contour-generating image signals) are only supplied to the false contour reducing portion 3.

Here, the "specific color ranges in which false contours will possibly occur" may be, for example, fleshtones (human faces or similar) and whites (clouds or similar). Gradations of such color ranges are, in the example of FIG. 2, the gradations 222±30 for red pixels, the gradations 180±30 for green pixels, and the gradations 164±35 for blue pixels.

Hence among the candidate pixels from the area detection portions 5*a* to 5*n*, the specific color detection portion 6 supplies to the false contour reduction portion 3, as pixels at which false contours occur, only those pixels in the range of gradations 222±30 for red pixels, supplies to the false contour reduction portion 3, as pixels at which false contours occur, only those pixels in the range of gradations 180±30 for green pixels, and supplies to the false contour reduction portion 3, as pixels at which false contours occur, only those pixels in the range of gradations 164±30 for blue pixels.

Here, as the specific color ranges for the specific color detection portion 6 to decide that false contours occur, only one set of example is described for the three primary colors: the red color range is gradations 222±30, the green color range is gradations 180±30, and the blue color range is gradations 164±30. It should be noted, however, that the specific color ranges can be set for a plurality of sets of color ranges. Hence the specific color detection portion 6 determines that a false contour occurs at a pixel, if the gradation of that pixel falls within any one of these sets of color ranges.

The settings for each color range can be determined separately for each of the primary colors (red, green and blue).

The setting modification portion 41 has a gradation modification unit (gradation range modification means) 411, an area modification unit (area modification means) 412, and a specific color modification unit (specific color modification means) 413. The gradation modification unit 411 performs gradation range modification processing to modify the upper-limit value and lower-limit value of the gradation range which is determined to be the false-contour-occurring range by the gradation detectors 4*a* to 4*n*. The area modification unit 412 performs area modification processing to modify the size of the area which is determined to be the false-contour-occurring area by the area detectors 5*a* to 5*n*. The specific color modification unit 413 performs processing to modify the color range which is determined to be the false-contour-occurring pixel color range by the specific color detector 6.

The setting modification execution portion 42 has a gradation modification execution portion 421, which causes execution of gradation range modification processing by the gradation modification unit 411; an area modification execution portion 422, which causes execution of area modification processing by the area modification unit 412; and a specific color modification execution portion 423, which causes execution of specific color modification processing by the specific color modification unit 413.

The false contour reduction portion 3 has an intermediate gradation processing portion 7 and a switching portion 8.

The intermediate gradation processing portion 7 reduces false contours (performs false contour reduction processing) by, for example, performing pseudo-intermediate gradation processing on the image signals introduced to the false contour reduction circuit 1. The intermediate gradation processing portion 7 uses the error diffusion processing as the pseudo-intermediate gradation processing.

The switching portion 8 receives the image signal introduced to the false contour reduction circuit 1 (first image signal), that is, the image signal without being processed by the intermediate gradation processing portion 7, and the image signal processed by the intermediate gradation processing portion 7 (second image signal), and outputs one of these two image signals.

The switching portion 8 selects the second image signal as an image signal used in the display of pixels at which it is determined (or predicted) by the false contour occurrence pixel determination unit 2 that false contours occur, and selects the first image signal as an image signal used in the display of other pixels. The switching portion 8 transmits the selected image signal to the display portion 32 (FIG. 6) having the plasma display panel 50.

In other words, the switching portion 8 substitutes image signals subjected in advance to false contour reduction processing for image signals which the false contour occurrence pixel determination unit 2 has decided are used in the display of pixels at which false contours occur.

In the display screen of the display device (plasma display panel 50), an image is displayed based on image signals which are false-contour-reduction processed by the false contour reducing portion 3.

Hence the occurrence of false contours in the display screen can be reduced, and degradation of the quality of the displayed image can be reduced to a minimum.

Figure 5:
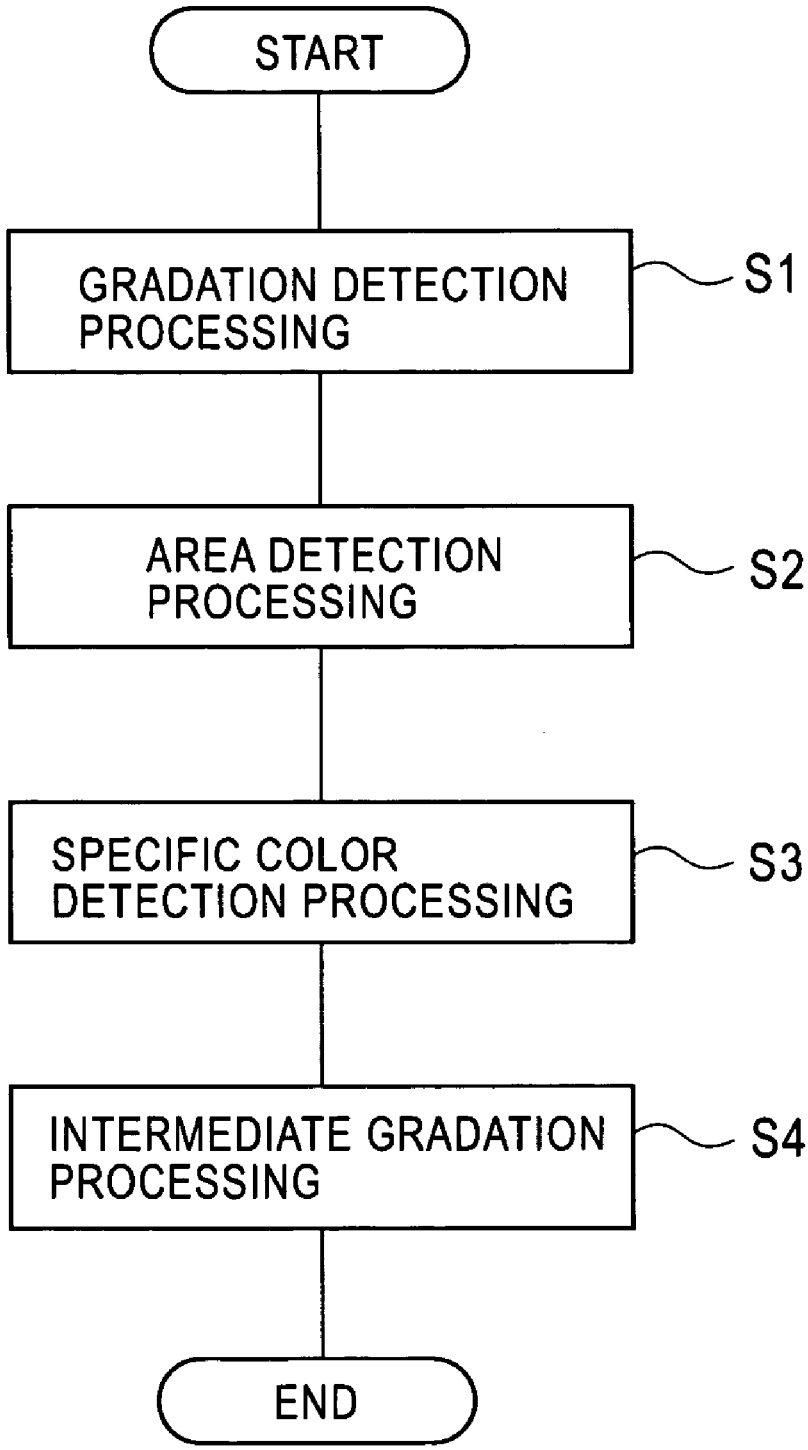
FIG. 5 is a flowchart showing the processing performed by the false contour reduction circuit shown in FIG. 1.

Next, the operation performed by the false contour reduction circuit 1 of FIG. 1 will be described with reference to the flowchart of FIG. 5.

First, in step S1, each of the red, green, and blue image signals used in display of pixels within a prescribed gradation range is extracted (gradation detection processing) from among the input image signals.

That is, step S1 is performed by the gradation detection portions 4*a* to 4*n* of the false contour occurrence pixel determination unit 2.

In step S2, only those image signals used in display of pixels existing continuously over a prescribed display area are extracted from among the image signals extracted in step S1 (area detection processing). Step S2 is performed by the area detection portions 5*a* to 5*n* of the false contour occurrence pixel determination unit 2.

In step S3, only those image signals used in display of pixels with gradations in a specific color range in which false contours occur are extracted from among the image signals extracted in step S2 (specific color detection processing). Step S3 is performed by the specific color detection portion 6 of the false contour occurrence pixel determination unit 2.

In step S4 false contour reduction processing is performed on the image signals extracted in step S3 to reduce false contours. Specifically, false contour reduction processing is performed in advance on all image signals, and the image signals on which false contour reduction processing has been performed are used for the image signals extracted in step S3, whereas the original image signals, without false contour reduction processing performed, are used for image signals other than the image signals extracted in step S3. By this means, false contours can be reduced in only the image signals extracted in step S3 (intermediate gradation processing). Step S4 is performed by the false contour reducing portion 3.

Figure 6:
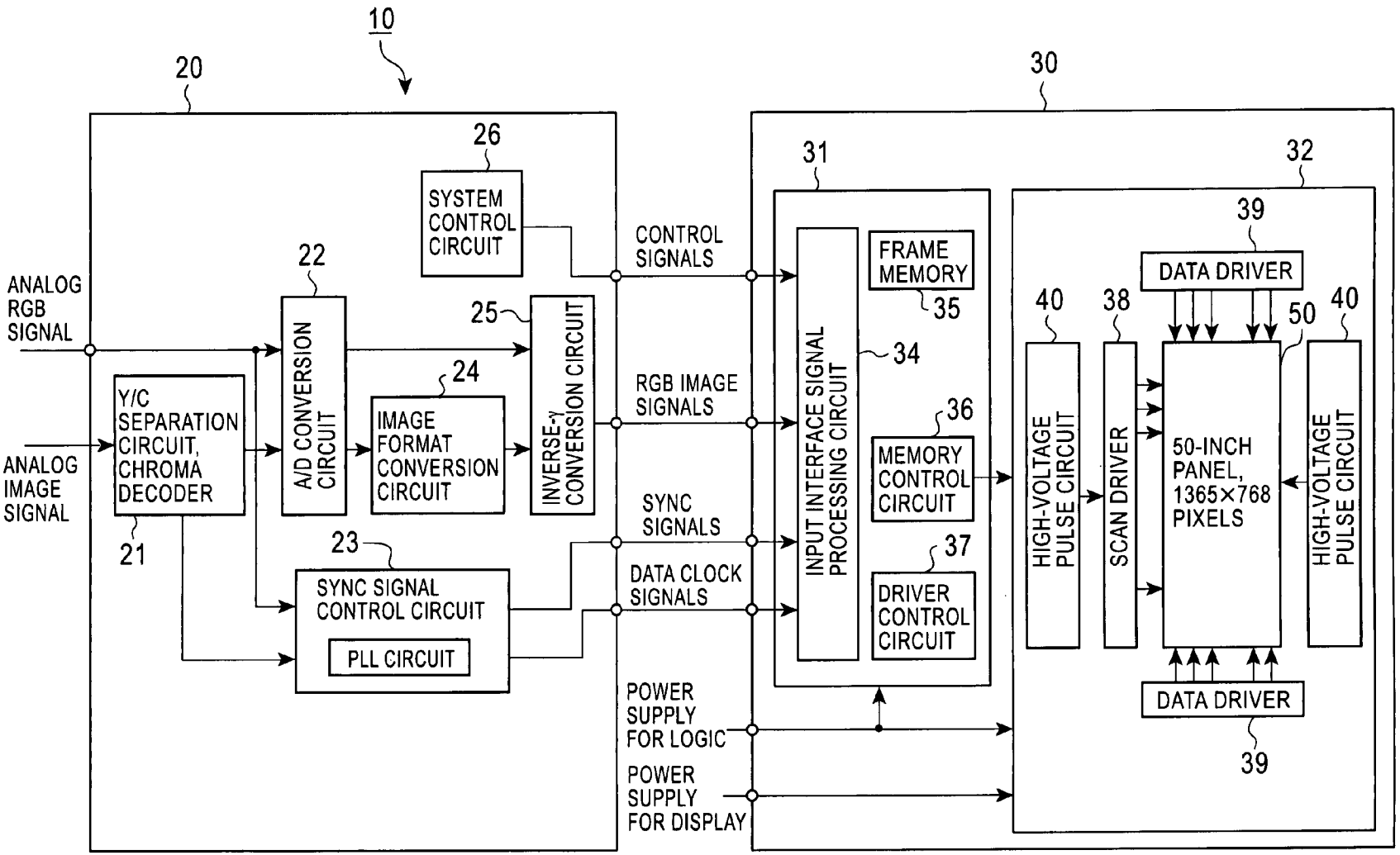
FIG. 6 is a block diagram of a display device having the false contour reduction circuit of FIG. 1.

Referring to FIG. 6, a plasma display device 10 of this embodiment will be described.

As shown in FIG. 6, the plasma display device 10 is designed to have a modular structure, and more specifically, includes an analog interface 20 and a plasma display panel module 30.

The analog interface 20 includes a Y/C separation circuit 21 having a chroma decoder, an A/D conversion circuit 22, a synchronization signal control circuit 23 having an PLL circuit, an image format conversion circuit 24, an inverse-γ (gamma) conversion circuit 25, and a system control circuit 26.

The analog interface 20 converts a received analog image signal into a digital image signal, and supplies this digital image signal to the plasma display panel module 30.

For example, the analog image signals issued from a television tuner are separated into brightness (luminance) signals and color difference signals by the Y/C separation circuit 21, and converted into RGB digital signals by the A/D converter circuit 22.

Then, if the pixel configuration in the plasma display panel module 30 differs from the pixel configuration of the image signals, the necessary image format conversion is performed by the image format conversion circuit 24.

The display brightness characteristic is linearly proportional to the signal introduced to the plasma display panel, but normal image signals are corrected (γ-converted) in advance according to the characteristics of a CRT. Hence after A/D conversion of the image signal in the A/D conversion circuit 22, inverse-γ conversion of the image signals is performed in the inverse-γ conversion circuit 25, to generate digital image signals with the linear characteristics restored. These digital image signals are sent as RGB image signals to the plasma display panel module 30.

Analog image signals do not include sampling clock and data clock signals for A/D conversion, and so the synchronization signal control circuit 23 generates sampling clock and data clock signals with a horizontal synchronization signal supplied simultaneously with the analog image signal as reference, and supplies these clock signals to the plasma display panel module 30.

The system control circuit 26 issues various control signals to the plasma display panel module 30.

The plasma display panel module 30 has a digital signal processing circuit 31 and a panel portion 32.

The digital signal processing/controlling circuit 31 has an input interface signal processing circuit 34, frame memory 35, memory control circuit 36, and driver control circuit 37.

The input interface signal processing circuit 34 receives various control signals sent from the system control circuit 26, RGB image signals sent from the inverse-γ conversion circuit 25, synchronization signals sent from the synchronization signal control circuit 23, and data clock signals sent from the PLL circuit.

After processing of the various signals in the input interface signal processing circuit 34, the digital signal control circuit 31 sends the control signals to the panel unit 32. Simultaneously, the memory control circuit 36 and driver control circuit 37 send memory control signals and driver control signals to the panel portion 32.

The false contour reduction circuit 1 is included in the input interface signal processing circuit 34.

The display panel unit 32 includes a plasma display panel 50, scan driver 38 which drives the scanning electrodes, data driver 39 which drives the data electrodes, and high-voltage pulse circuit 40 which supplies pulse voltages to the plasma display panel 50 and scan driver 38.

The plasma display panel 50 is configured having a 1365×768 matrix of pixels. In the plasma display panel 50, the scan driver 38 controls the scanning electrodes and the data driver 39 controls the data electrodes, to control the lighting and extinction of the pixels thereby displaying the desired image.

As described above, according to the first embodiment, the false contour reducing portion 3 performs false contour reduction processing on specific color false-contour-generating image signals. The specific color false-contour-generating image signals are those image signals at which false contours occur and which have a color within a certain color range. Hence in the image display using the subfield driving, the occurrence of the false contours can be reduced, and degradation of image quality can be reduced to a minimum. That is, perception by an observer of gradation inversion in images, and perception as different colors, can be reduced.

The false contour occurrence pixel determination unit 2 includes the specific color detection unit 6 so that it is possible to apply the false contour reducing process on the specific color false-contour-generating image signals which have certain color(s) in the specific color range among the false-contour-generating image signals. It should be noted here that false contours are not outstanding (i.e., not noticeable very much) in particular colors. Therefore, it may be unnecessary to apply the false contour reduction process on the image signals if such color is displayed on the screen. In this embodiment, it is possible not to apply the false contour reducing process on those image signals which have such colors. By not always applying the false contour reducing process, the image quality deterioration due to the false contour reducing process can be decreased.

The false contour occurrence pixel determination unit 2 also includes the area detection portions 5*a* to 5*n*, and so when the size of the display region in the false-contour-generating gradation range is small, the false contour reduction processing may not be executed. Hence degradation of image quality arising from false contour reduction processing can be mitigated.

Second Embodiment

Figure 7:
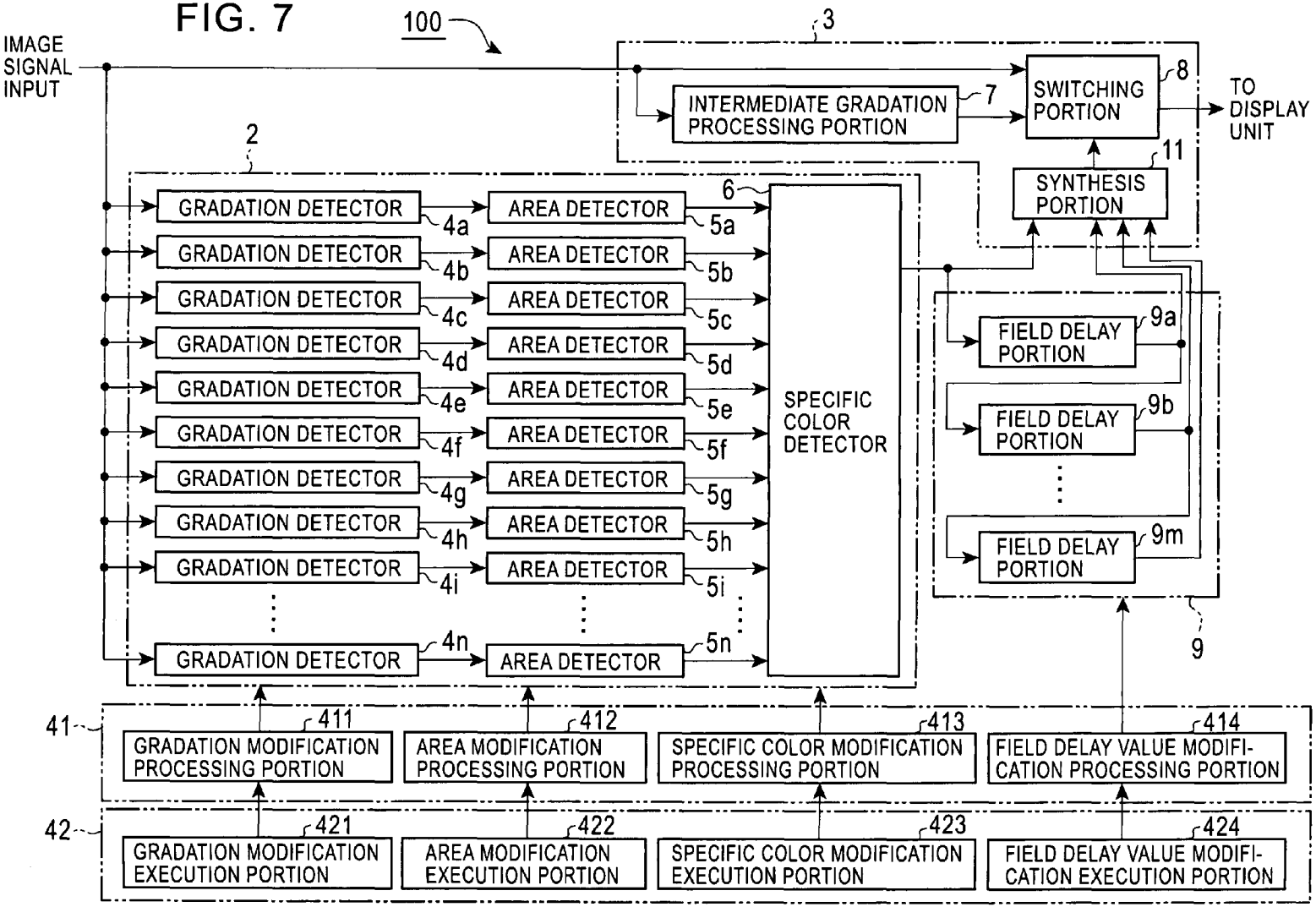
FIG. 7 illustrates a block diagram of the false contour reduction circuit according to a second embodiment of the present invention.

Referring to FIG. 7, the false contour reduction circuit 100 of a second embodiment will be described.

The false contour reduction circuit 100 of the second embodiment has a configuration similar to that of the false contour reduction circuit 1 of the first embodiment, with the exception of the points described below. Hence the same symbols are assigned to similar constituent components, and redundant explanations are omitted.

In the second embodiment, the false contour reducing portion 3 also performs false contour reduction processing on image signals which are introduced later than the specific color false-contour-generating image signals determined by the false contour occurrence pixel determination unit 2 (preceding false-contour-generating image signals), and which are displayed at the same screen locations as the preceding false-contour-generating image signals.

In order to realize this operation, the false contour reduction circuit 100 of the second embodiment further includes, in addition to the configuration of the false contour reduction circuit 1 of the first embodiment, a delay portion 9 which delays input of image signals to the false contour reducing portion 3.

This delay portion 9 includes, for example, first to mth field delay portions 9*a*, 9*b*, . . . , and 9*m*, (where m is a positive integer) which delay input to the false contour reducing portion 3 of image signals used in the display of pixels at which the false contour occurrence pixel determination unit 2 has decided that false contours occur, by one to m fields. The field delay portions 9*a* through 9*m* are provided in the number of the desired field delay amount.

The false contour reducing portion 3 of the false contour reduction circuit 100 of the second embodiment includes, in addition to the configuration of the false contour reducing portion 3 of the false contour reduction circuit 1 in the first embodiment, a synthesis portion 11 which calculates the logical sum of the image signals introduced from the first to mth field delay portions 9*a* to 9*m* and from the false contour occurrence pixel determination unit 2, and supplies the logical sum to the switching portion 8.

Each of the field delay portions 9*a* to 9*m* is configured so as to issue image signals delayed by one field interval; the field delay portions 9*a* to 9*m* are connected in series. The outputs from the field delay portions 9*a* to 9*m*-1 are introduced to the respective next-stage field delay portions 9*b* to 9*m* and to the synthesis portion 11. The output from the last filed delay portion 9*m* is introduced to the synthesis portion 11 only.

The setting modification portion 41 of the false contour reduction circuit 100 in the second embodiment includes, in addition to the configuration of the setting modification portion 41 of the false contour reduction circuit 1 of the first embodiment, a field delay value modification portion 414, which performs field delay value modification processing to change (or to select) which field delay portion's input to the false contour reducing portion 3 should be a valid input among the inputs from the field delay portions 9*a* to 9*m*.

The setting modification execution portion 42 of the false contour reduction circuit 100 of the second embodiment includes, in addition to the configuration of the setting modification execution portion 42 of the false contour reduction circuit 1 of the first embodiment, a field delay value modification execution portion 424 to cause execution of field delay value modification processing by the field delay value modifying portion 414.

Next, operation of the false contour reduction circuit of this embodiment will be described with reference to the flowchart of FIG. 8.

Figure 8:
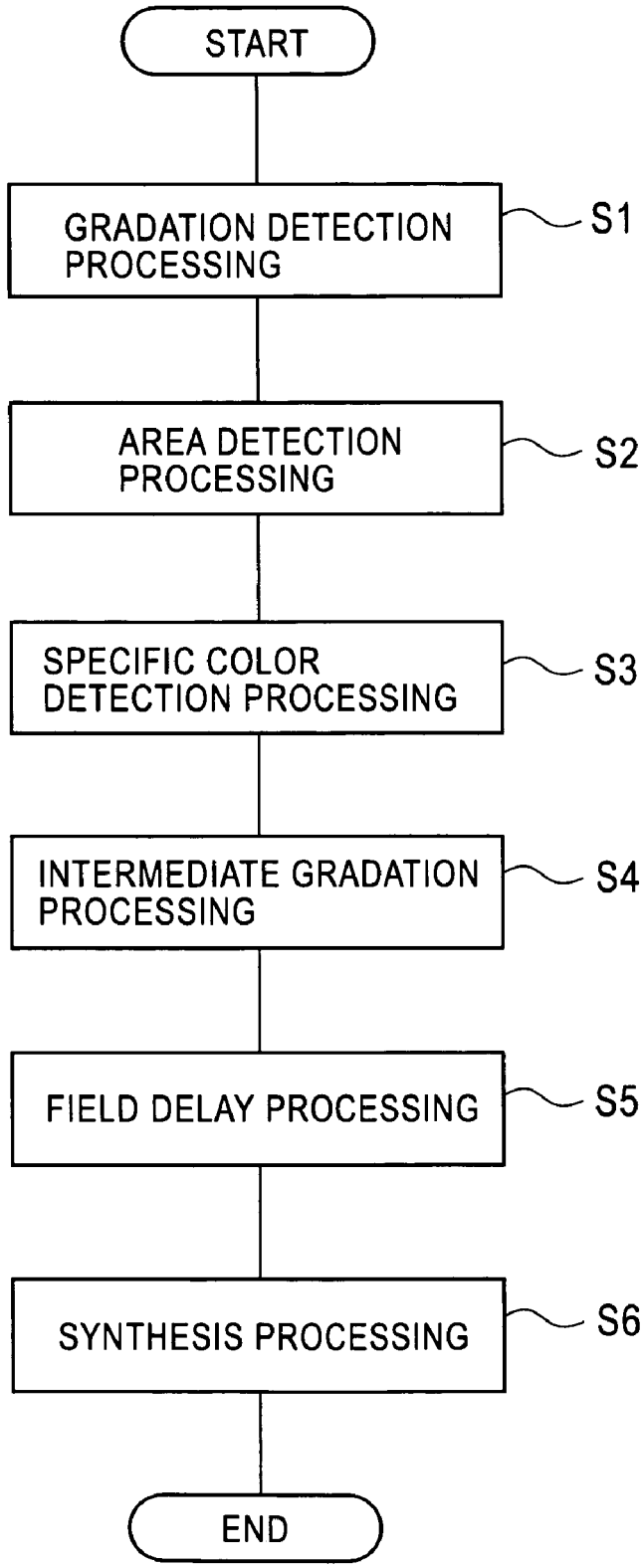
FIG. 8 is a flowchart of processing performed by the false contour reduction circuit shown in FIG. 7.

In this embodiment, as shown in FIG. 8, as compared with the first embodiment (FIG. 5) the field delay processing of step S5 and the synthesis processing of step S6 are added.

The field delay processing is performed by the delay portion 9.

Of the field delay portions 9*a* to 9*m* of the delay portion 9, the first-stage field delay portion 9*a* delays image signals introduced from the false contour occurrence pixel determination unit 2 by one field, and supplies the image signals to the next-stage field delay portion 9*b* and to the synthesis portion 11.

Similarly, the field delay portion 9*b* delays the image signals supplied from the previous-stage field delay portion 9*a* by one field, and supplies the signals to the next-stage field delay portion 9*c* (not shown) and to the synthesis portion 11.

Similarly in subsequent stages, the field delay portions 9*c* to 9*m*-1 (not shown) delay by one field the image signals sent from the preceding field delay portions 9*b* to 9*m*-2 (not shown), and supply the image signals to the next-stage field delay portions 9*d* (not shown) to 9*m* and to the synthesis portion 11.

By this operation, the first through mth field delay portions 9*a* to 9*m* of the delay portion 9 delay, by 1 through m fields, the input to the false contour reducing portion 3 of image signals used in display of pixels at which the false contour occurrence pixel determination unit 2 has determined false contours occur.

Next, the synthesis processing is described.

The synthesis processing is performed by the synthesis portion 11 of the false contour reducing portion 3.

The synthesis portion 11 takes the logical sum of the image signals sent from the false contour occurrence pixel determination unit 2 and from the first through mth field delay portions 9*a* to 9*m*, and sends the logical sum to the switching portion 8.

Hence when an image signal is sent to the false contour reducing portion 3 from the false contour occurrence pixel determination unit 2, the switching portion 8 substitutes the image signal on which false contour reduction processing has been performed for the original image signal and supplies the false-contour-reduced signal to the display portion, and in addition, when an image signal has been introduced from at least one among the first through mth field delay units, the switching portion 8 substitutes the image signal on which false contour reduction processing has been performed for the original signal, and supplies the signal to the display portion.

Thus the second embodiment can achieve advantageous results similar to those of the first embodiment. Besides, because the delay portion 9 and synthesis portion 11 are included in the false contour reduction circuit 100, false contour reduction processing is also performed by the false contour reduction processing portion 3 on image signals introduced with a delay of one through m field intervals after image signals used in the display of pixels at which the false contour occurrence pixel determination unit 2 has determined that false contours occur, and used in the display at the same display locations as the previous image signals, and the result is transferred to the display portion. Hence false contours can also be reduced in images which are introduced at timing close (close field timing) to the timing of occurrence of false contours.

Third Embodiment

Figure 9:
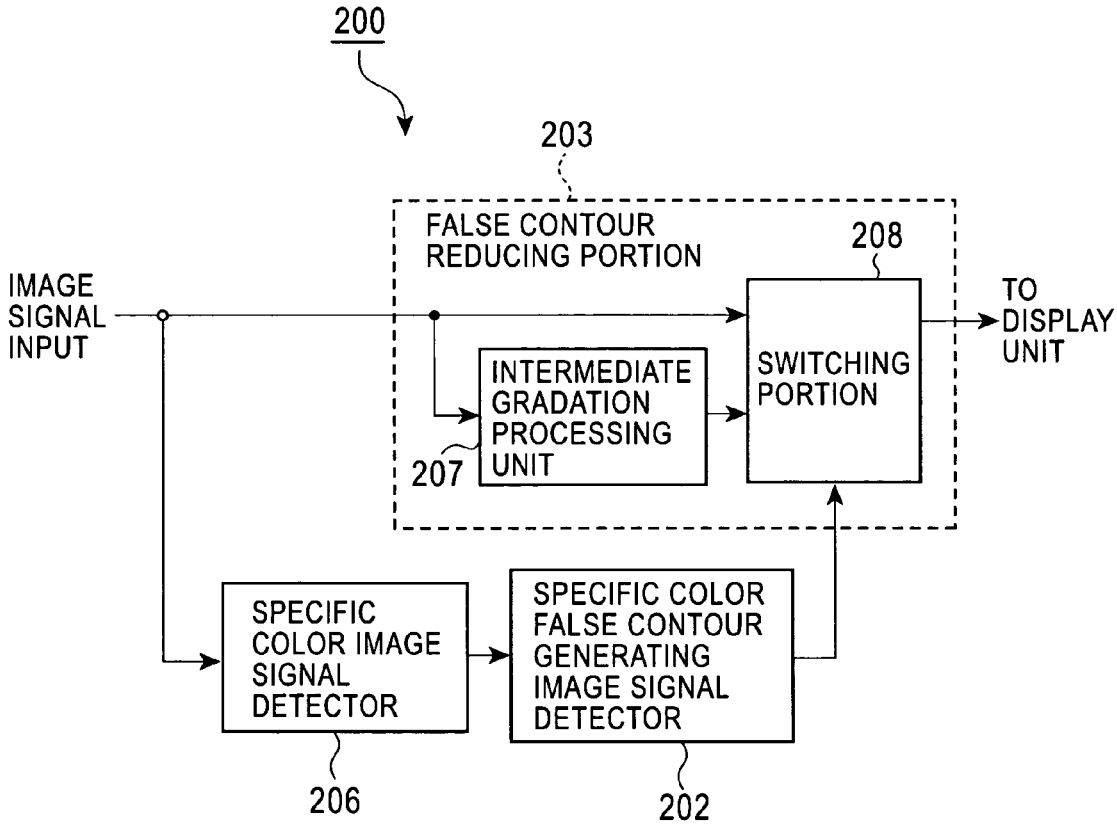
FIG. 9 illustrates a block diagram of a display apparatus according to a third embodiment of the present invention.

Referring to FIG. 9, a third embodiment will be described. FIG. 9 shows a false contour reduction circuit 200 of the third embodiment.

As shown in FIG. 9, the false contour reduction circuit 200 includes a specific color image signal detector 206 to detect image signals of pixels having a color within a certain color range, among the input image signals introduced to the false contour reduction circuit 200. The "certain color range" is the range in which a viewer (human) easily recognizes or notices a false contour. The detected image signal is called "specific color image signal." The false contour reduction circuit 200 also includes a specific color false-contour-generating image signal detector 202 to detect image signals which will generate false contours, among the specific color image signals detected by the specific color image signal detector 206. The detected image signals are called "specific color false-contour-generating image signals." The false contour reduction circuit 200 also includes a false contour reduction processing unit 203 to perform a false contour reduction process on the specific color false-contour-generating image signals.

The specific color image signal detector 206 is similar to the specific color detector 6 in the first and second embodiments. The specific color image signal detector 206 defines a certain color range in which a false contour is noticeable, and transmits only those pixels which have colors within this color range to the specific color false-contour-generating image signal detector 202, as the false-contour-generating pixels. Each pixel is made up from three primary colors, i.e., red R, green G and blue B, so that the "certain color range" is defined in fact as a certain red color range, a certain green color range and a certain blue color range. The specific color image signal detector 206 detects the input image signals within these color ranges. The specific color range may include a plurality of ranges, such as a flesh color range, a white color range and the like.

Figure 11:
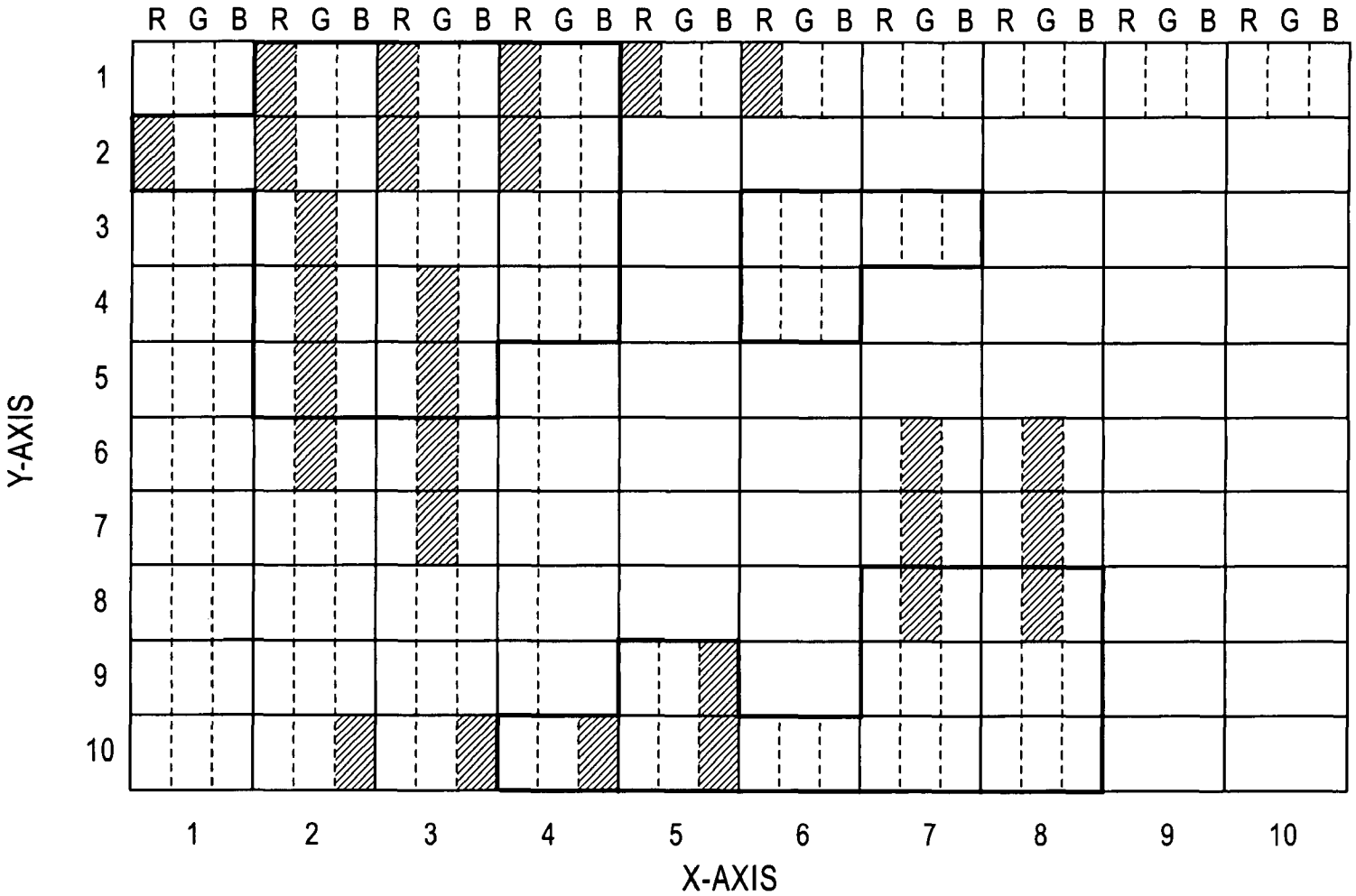
FIG. 11 illustrates a display screen.
Figure 12A:
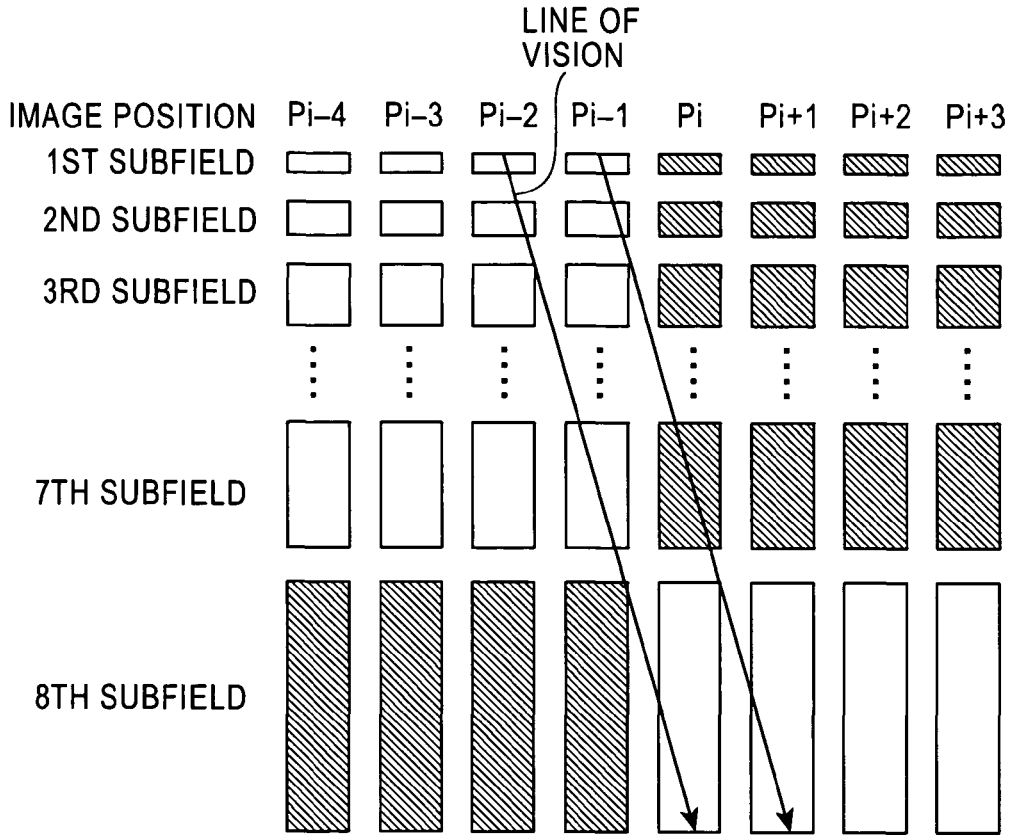
FIGS. 12A and 12B show in combination how false contours occur.
Figure 12B:
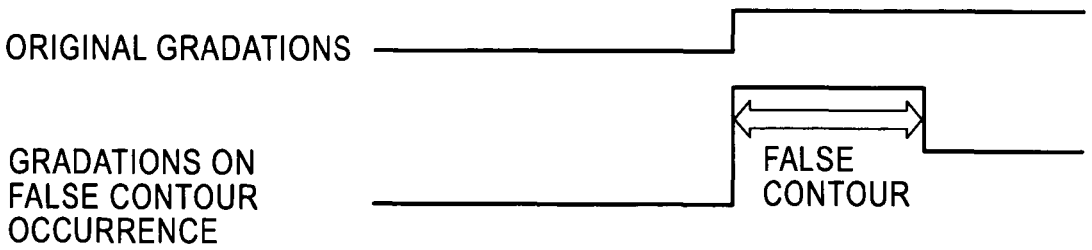

Referring to FIG. 11, a display screen having 100 pixels is illustrated. This display screen has ten dots in the horizontal direction (X axis) and ten lines in the vertical direction (Y axis). Each pixel has three cells (i.e., R cell, G cell and B cell). Input image signals which are worth of this 100-pixel display signal are introduced to the false contour reduction circuit 200. Among these input image signals, those image signals which have colors in a specific color range are detected. This color range is a range which will generate noticeable false contours, and indicated by the areas surrounded by the bold line in FIG. 11.

The specific color false-contour-generating image signal detector 202 is similar to the determination unit 2 in the first and second embodiments. The specific color false-contour-generating image signal detector 202 uses the following two steps to detect image signals which will generate false contours (specific color false-contour-generating image signals) among the specific color image signals issued from the specific color image signal detector 206.

In the first step, pixels in a predetermined gradation range are taken as candidate pixels which will possibly noticeable generate false contours. Specifically, it is determined whether the image signals of the red, green and blue pixels in the color areas surrounded by the bold line in FIG. 11 are within the predetermined gradation ranges. For example, if the red pixel signal is within the predetermined gradation range, the red pixel signal is determined to be the candidate pixel for false contour generation. In FIG. 11, the red pixels at the XY coordinates (1,2), (2,1), (2,2), (3,1), (3,2), (4,1), (4,2) are within the predetermined gradation range. Thus, these red pixels are candidate pixels. The green pixels at the XY coordinates (2,3), (2,4), (2,5), (3,4), (3,5), (7,8), (8,8) are within the predetermined gradation range. The blue pixels at the XY coordinates (5,9), (4,10), (5,10) are within the predetermined gradation range. In FIG. 11, the candidate pixels are hatched.

The second step determines whether the candidate pixels detected in the first step exist continuously more than a predetermined amount. Only when the candidate pixels continues more than the predetermined amount, the second step determines that the candidate pixels are specific color false-contour-generating pixels. In other words, when the candidate pixels extend over a certain size of area, the image signals of these pixels are determined to be the false-contour-generating image signals.

For example, it is determined in the second step whether there are three candidate pixels continuously existing in the horizontal direction and/or vertical direction of the screen. In FIG. 11, the candidate pixels at (1,2), (2,1), (2,2), (2,3), (2,4), (2,5), (3,1), (3,2), (3,4), (3,5), (4,1) and (4,2) meet the above-mentioned requirement. Also, the three candidate pixels at (5,9), (4,10), (5,10) meet the above-mentioned requirement. The candidate pixels at (7,8) and (8,8) are the two continuous pixels, but there is no third candidate pixel, so that these candidate pixels are not determined to be the specific color false-contour-generating pixels. It should be noted that the candidate pixels at (5,9), (4,10) and (5,10) are "three continuous pixels" in the determination in the foregoing description, but the second step may require that three candidate pixels must extend linearly (horizontal direction or vertical direction). In this case, the candidate pixels at (5,9), (4,10) and (5,10) will not be determined to be the specific color false-contour-generating pixels because only two pixels continuously exist in the horizontal direction (pixels at (4,10) and (5,10)) and only two pixels continuously exist in the vertical direction (pixels at (5,9) and (5,10)).

As described above, the image signals of the specific color false-contour-generating pixels determined by the specific color false-contour-generating image signal detector 202 (specific color false-contour-generating image signals) are supplied to the false contour reduction processing unit 203. The false contour reduction processing unit 203 has an intermediate gradation processing unit 207 and a switching unit 208. This is similar to the first embodiment; the false contour reduction processing unit 203 corresponds to the false contour reduction processing unit 3 in FIG. 1, the intermediate gradation processing unit 207 corresponds to the intermediate gradation processing unit 7 in FIG. 1, and the switching unit 208 corresponds to the switching unit 8 in FIG. 1. The false contour reduction processing unit 203 functions in the same way as the false contour reduction processing unit 3 in the first embodiment so that a description thereof is omitted.

Figure 10:
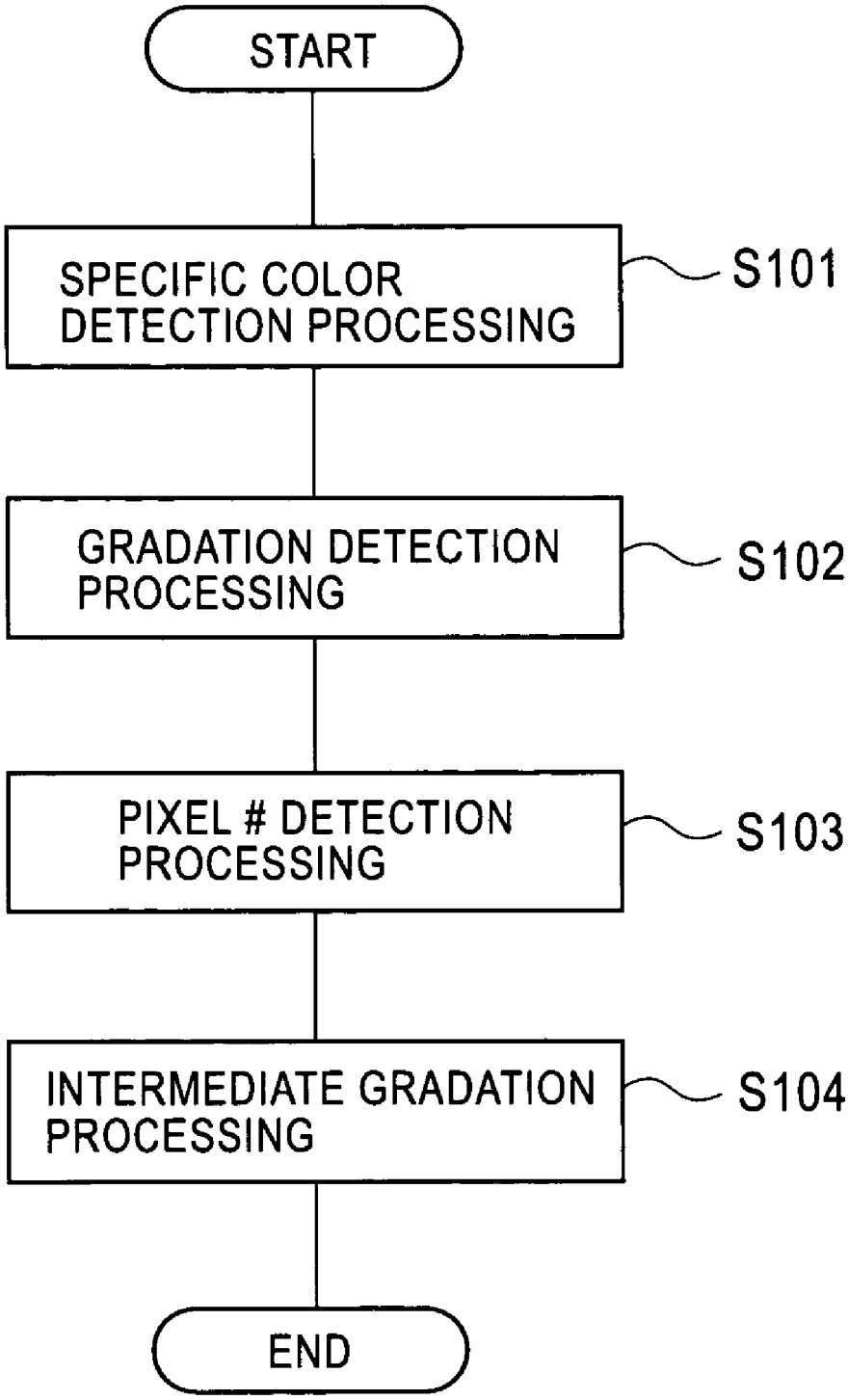
FIG. 10 illustrates a flowchart of processing performed by the a false contour reduction circuit shown in FIG. 9.

Referring now to FIG. 10, the operation of the false contour reduction circuit 200 shown in FIG. 9 will be described.

At step S101, the specific color detection is carried out on the input image signal by the specific color image signal detector 206.

At step S102, the false-contour-generating image signal detector 202 extracts the image signals having a gradation within the predetermined gradation range, from the specific color image signals detected in step S101, for each of the red, green and blue colors. The extracted image signals are specific color false-contour-generating image signals. This step is a gradation detection step.

At step S103, the image signals having pixels which continuously exist over a predetermined number are extracted from the image signals extracted at step S102. This step is a pixel number detection step, and corresponds to the area detection step (step S2) in FIG. 8.

At step S104, the intermediate gradation process is carried out on the specific color false-contour-generating image signals extracted at step S103. The intermediate gradation process is the false contour reduction process to reduce the false contours. In this embodiment, the false contour reduction process is applied to all the image signals in advance. Thus, the image signals extracted at step S103 have already undergone the "false contour reduction process." Thus, step S104 simply passes the image signals therethrough if the image signals come from step S103. For other image signals, those image signals which have not undergone the false contour reduction process are issued from step S104. As a result, the false contour reduction process is only applied on those image signals which are extracted at step S103. Step S104 is an intermediate gradation step.

It should be noted that step S101 may be performed after step S102. Alternatively, step S101 and step S102 are applied in parallel to the input image signals. Specifically, the specific color false-contour-generating image signals which qualify the requirement of step S101 and the requirement of step S102 may be detected. Then, step S103 is applied to the specific color false-contour-generating image signals, and step S104 is applied. In any event, same results are achieved after step S104. Characteristics of the specific color detection process and gradation detection process are considered when deciding the arrangement of steps S101 to S104. Also, size, throughput and efficiency of a hardware used for these processes may be taken into account.

Although the circuit arrangement shown in FIG. 9 does not include the gradation modification unit, area modification unit, specific color modification unit, gradation modification unit, area modification execution unit and specific color modification execution unit, the circuit arrangement may include these units, as in the first embodiment (FIG. 1).

It should be noted that the false contour reduction unit 203 may apply the false contour reduction process on the subsequent image signals, which are introduced after the image signals in question and which will be displayed at the same display locations as the preceding image signals, as in the second embodiment. In this case, the field delay step (FIG. 8) and the synthesizing process (FIG. 8) are added after step S104 in the flowchart of FIG. 10.

The third embodiment can achieve the same advantages as the first and second embodiments.

In the above described embodiments, only cases in which color images are displayed on the display screen are described; but this invention can also be applied to cases in which monochromatic images are displayed on the display screen. In this case, the false contour occurrence pixel determination unit 2 may not include the gradation detectors 4*a* to 4*i* and the area detectors 5*a* to 5*i* for each color.

In the above described embodiments, the false contour reduction processing is performed only when there exist continuous pixels in or over a prescribed display region and when these pixels have gradations within a prescribed gradation range; but the false contour reduction processing may be performed in cases where individual pixels exist in prescribed gradation ranges. In this case, the false contour occurrence pixel determination unit 2 need not include area detection portions 5*a* to 5*i*.

In the above described embodiments, the pseudo-intermediate gradation processing is used as the false contour reducing process, but the present invention is not limited in this regard. For example, the false contours may be reduced by rearranging the pixel values in the pixel series of the false-contour-generating image signals under a certain constraint, as disclosed in Japanese Patent Kokai (Laid Open Application) No. 2003-157045. The disclosure of this Japanese Patent Kokai is incorporated herein by reference.

This application is based on a Japanese Patent Application No. 2004-148114 filed on May 18, 2004 and the entire disclosure thereof is incorporated herein by reference.

What is claimed is:

1. A false contour reduction device, which reduces an occurrence of a false contour on a display screen of a display device, comprising:

a false contour reducing unit for performing a false contour reducing process on a specific color false-contour-generating image signal, wherein the specific color false-contour-generating image signal comprises an image signal which comprises a false-contour-generating image signal and which has a specific color in a specific color range among input image signals, wherein the false-contour-generating image signal comprises an image signal which will generate a false contour, wherein the false contour reduction device further comprises:

a false-contour-generating image signal detector for detecting the false-contour-generating image signal among the input image signals; and a specific color false-contour-generating image signal detector for detecting the specific color false-contour-generating image signal among the false-contour-generating image signal detected by the false-contour-generating image signal detector, wherein the false contour reducing unit performs a first false contour reducing process on the specific color false-contour-generating image signal detected by the specific color false-contour-generating image signal detector, wherein the false-contour-generating image signal detector determines that the input image signals comprise the false-contour-generating image signal when at least one color image signal among a plurality of color image signals in the input image signals falls within a predetermined gradation range and a pixel corresponding to such color image signal continuously exists over a predetermined area on the display screen in a single frame, wherein the false contour reduction device further comprises a first through mth field delay units located between the specific color false-contour generating image signal detector and the false contour reduction unit for delaying, by one through m fields, introduction of the specific color false-contour-generating image signal to the false contour reducing unit, wherein the false contour reducing unit also performs at least a second false contour reducing process when the specific color false-contour-generating image signal is introduced to the false contour reducing unit from at least one of the first through mth field delay units, on a subsequent input image signal which is introduced to the false contour reducing unit later than the specific color false-contour-generating image signal and which is used in the display device at a same display screen location as the specific color false-contour-generating image signal, even if said subsequent input image signal is not the false-contour-generating image signal, and wherein, whether said at least the second false contour reducing process is performed is decided based on a detection result on a preceding image signal by the false-contour-generating image signal detector.

2. The false contour reduction device according to claim 1, wherein the false-contour-generating image signal detector determines that the input image signal comprises the false-contour-generating image signal when at least one color image signal among a plurality of color image signals in the input image signal falls within a predetermined gradation range.

3. The false contour reduction device according to claim 1, wherein the false contour reducing unit performs pseudo-intermediate gradation processing as the false contour reducing process.

4. The false contour reduction device according to claim 1, wherein the false contour reducing unit includes:

a processing portion which performs the false contour reducing process on a first image signal which comprises the input image signal, so as to generate a second image signal which comprises a false-contour-processed signal; and a switching portion for receiving the first image signal and the second image signal to select one of the first and second image signals, and wherein the switching portion selects the second image signal if the corresponding input image signal is determined to be the specific color false-contour-generating image signal, and otherwise selects the first image signal.

5. A display device comprising:

a false contour reduction device defined in claim 1; and a display unit having a display screen to display an image based on the image signals which have undergone the false contour reducing process performed by the false contour reduction device.

6. The display device according to claim 5, wherein the false-contour-generating image signal detector determines that the input image signal comprises the false-contour-generating image signal when at least one color image signal among a plurality of color image signals in the input image signal falls within a predetermined gradation range.

7. The display device according to claim 5, wherein the false-contour-generating image signal detector determines that the input image signal comprises the false-contour-generating image signal when at least one color image signal among a plurality of color image signals in the input image signal falls within a predetermined gradation range and a pixel corresponding to such color image signal continuously exists over a predetermined area on the display screen.

8. The display device according to claim 5, wherein the false contour reduction device further includes:

a specific color image signal detector for detecting the image signal having the specific color among the input image signals; and a specific color false-contour-generating image signal detector for detecting the specific color false-contour-generating image signal which will generate a false contour, among the image signal having the specific color detected by the specific color image signal detector, wherein the false contour reducing unit performs the false contour reducing process on the specific color false-contour-generating image signal detected by the specific color false-contour-generating image signal detector.

9. The display device according to claim 8, wherein the specific color false-contour-generating image signal detector determines that the image signal having the specific color comprises the specific color false-contour-generating image signal when at least one color image signal among a plurality of color image signals in the image signal having the specific color falls within a predetermined gradation range.

10. The display device according to claim 9, wherein the false-contour-generating image signal detector determines that the image signal having the specific color comprises the specific color false-contour-generating image signal when at least one color image signal among a plurality of color image signals in the image signal having the specific color falls within a predetermined gradation range and a pixel corresponding to such color image signal continuously exists over a predetermined area on the display screen.

11. The display device according to claim 5, wherein the false contour reducing unit performs pseudo-intermediate gradation processing as the false contour reducing process.

12. The display device according to claim 5, wherein the false contour reducing unit includes:

a processing portion which performs the false contour reducing process on a first image signal which comprises the input image signal, so as to generate a second image signal which comprises a false-contour-reduced image signal; and a switching portion for receiving the first image signal and the second image signal to select one of first and second image signals, and wherein the switching portion selects the second image signal if the corresponding input image signal is determined to be the specific color false-contour-generating image signal, and otherwise selects the first image signal.

13. The display device according to claim 5, wherein the false contour reducing unit also performs the false contour reducing process on second input image signals which are introduced thereto later than the specific color false-contour-generating image signal and which are used in a display at same display screen locations as the input image signals.

14. The display device according to claim 13, wherein the false contour reduction device further includes first through mth field delay units for delaying, by one through m fields, introduction of the specific color false-contour-generating image signal to the false contour reducing unit, and wherein the false contour reducing unit also performs the false contour reducing process when the specific color false-contour-generating image signal is introduced to the false contour reducing unit from at least one of the first through mth field delay units, thereby also performing the false contour reducing process on those input image signals which are introduced later than the specific color false-contour-generating image signals and which are used in the display at same display screen locations as the specific color false-contour-generating image signals.

15. A computer program embodied in a non-transitory machine-readable medium for causing a computer to perform a false contour reducing process by a false contour reduction device of claim 1.

16. The false contour reduction device according to claim 1, wherein said at least the second false contour reducing process is performed when it is determined that the preceding image signal creates the false contour.

17. The false contour reduction device according to claim 1, wherein said at least the second false contour reducing process is performed regardless of whether the second image signal creates the false contour.

18. The false contour reduction device according to claim 1, wherein said at least the second false contour reducing process is performed when the preceding image signal is received.

19. The false contour reduction device according to claim 1, wherein said at least the second false contour reducing process is performed when applying of a preceding false-contour-reducing process is decided.

20. The false contour reduction device according to claim 1, wherein the false contour reducing process is performed on image signals that are other than the false contour.

21. A false contour reduction device, which reduces an occurrence of a false contour on a display screen of a display device, comprising:

a false contour reducing unit for performing a false contour reducing process on a specific color false-contour-generating image signal, wherein the specific color false-contour-generating image signal comprises an image signal which comprises a false-contour-generating image signal and which has a specific color in a specific color range among input image signals, wherein the false-contour-generating image signal comprises an image signal which will generate a false contour, wherein the false contour reduction device further comprises:

a false-contour-generating image signal detector for detecting the false-contour-generating image signal among the input image signals; and a specific color image signal detector for detecting an image signal having the specific color among the input image signals, wherein the false contour reducing unit performs a first false contour reducing process on the specific color false-contour-generating image signal which comprises the false-contour-generating image signal detected by the false-contour-generating image signal detector and which comprises the image signal having the specific color detected by the specific color image signal detector, wherein the false-contour-generating image signal detector determines that the input image signals comprise the false-contour-generating image signal when at least one color image signal among a plurality of color image signals in the input image signals falls within a predetermined gradation range and a pixel corresponding to such color image signal continuously exists over a predetermined area on the display screen in a single frame, wherein the false contour reduction device further comprises a first through mth field delay units located between the specific color false-contour-generating image signal detector and the false contour reduction unit for delaying, by one through m fields, introduction of the specific color false-contour-generating image signal to the false contour reducing unit, wherein the false contour reducing unit also performs at least a second false contour reducing process when the specific color false-contour-generating image signal is introduced to the false contour reducing unit from at least one of the first through mth field delay units, on a subsequent input image signal which is introduced to the false contour reducing unit later than the specific color false-contour-generating image signal and which is used in the display device at a same display screen location as the specific color false-contour-generating image signal, even if said subsequent input image signal is not the false-contour-generating image signal, and wherein, whether said at least the second false contour reducing process is performed is decided based on a detection result on a preceding image signal by the false-contour-generating image signal detector.

22. The false contour reduction device according to claim 21, wherein the false-contour-generating image signal detector determines that the input image signal comprises the false-contour-generating image signal when at least one color image signal among a plurality of color image signals in the input image signal falls within a predetermined gradation range.

23. The false contour reduction device according to claim 21, wherein the false-contour-generating image signal detector determines that the input image signal comprises the false-contour-generating image signal when at least one color image signal among a plurality of color image signals in the input image signal falls within a predetermined gradation range and a pixel corresponding to such color image signal continuously exists over a predetermined area on the display screen.

24. A false contour reduction device, which reduces an occurrence of a false contour on a display screen of a display device, comprising:

a false contour reducing unit for performing a false contour reducing process on a specific color false-contour-generating image signal, wherein the specific color false-contour-generating image signal comprises an image signal which comprises a false-contour-generating image signal and which has a specific color in a specific color range among input image signals, wherein the false-contour-generating image signal comprises an image signal which will generate a false contour, wherein the false contour reduction device further comprises:

a specific color image signal detector for detecting the image signal having the specific color among the input image signals; and a specific color false-contour-generating image signal detector for detecting the specific color false-contour-generating image signal which will generate a false contour, among the image signal having the specific color detected by the specific color image signal detector, wherein the false contour reducing unit performs a first false contour reducing process on the specific color false-contour-generating image signal detected by the specific color false-contour-generating image signal detector, wherein the false-contour reduction device determines that the input image signals comprise the false-contour-generating image signal when at least one color image signal among a plurality of color image signals in the input image signals falls within a predetermined gradation range and a pixel corresponding to such color image signal continuously exists over a predetermined area on the display screen in a single frame, wherein the false contour reduction device further comprises a first through mth field delay units located between the specific color false-contour generating image signal detector and the false contour reduction unit for delaying, by one through m fields, introduction of the specific color false-contour-generating image signal to the false contour reducing unit, wherein the false contour reducing unit also performs at least a second false contour reducing process when the specific color false-contour-generating image signal is introduced to the false contour reducing unit from at least one of the first through mth field delay units, on a subsequent input image signal which is introduced to the false contour reducing unit later than the specific color false-contour-generating image signals and which is used in the display device at a same display screen location as the specific color false-contour-generating image signal, even if said subsequent input image signal is not the false-contour-generating image signal, and wherein, whether said at least the second false contour reducing process is performed is decided based on a detection result on a preceding image signal by the specific color image signal detector.

25. The false contour reduction device according to claim 24, wherein the specific color false-contour-generating image signal detector determines that the image signal having the specific color comprises the specific color false-contour-generating image signal when at least one color image signal among a plurality of color image signals in the image signal having the specific color falls within a predetermined gradation range.

26. The false contour reduction device according to claim 25, wherein the false-contour-generating image signal detector determines that the image signal having the specific color comprises the specific color false-contour-generating image signal when at least one color image signal among a plurality of color image signals in the image signal having the specific color falls within a predetermined gradation range and a pixel corresponding to such color image signal continuously exists over a predetermined area on the display screen.

27. A method for reducing an occurrence of a false contour on a display screen of a display device, said method comprising:

detecting an image signal which will generate a false contour, among input image signals to provide a false-contour-generating image signal;

detecting a signal which has a specific color in a specific color range, among the false-contour-generating image signal, to provide a specific color false-contour-generating image signal;

performing a first false contour reducing process on the specific color false-contour-generating image signal, so as to reduce the false contour; and determining that the input image signals comprise the false-contour-generating image signal when at least one color image signal among a plurality of color image signals in the input image signals falls within a predetermined gradation range and a pixel corresponding to such color image signal continuously exists over a predetermined area on the display screen in a single frame, wherein the method further comprises delaying, by one through m fields, introduction of the specific color false-contour-generating image signal, wherein at least a second false contour reducing process is performed when the specific color false-contour-generating image signal is introduced from at least one of a first through mth field delay units, thereby performing said at least the second false contour reducing process on those input image signals which are introduced later than the specific color false-contour-generating image signals and which are used in the display device at same display screen locations as the specific color false-contour-generating image signals, and wherein said delaying is performed by the first through mth field delay units located between a specific color false-contour generating image signal detector and a false-contour reduction unit, even if a subsequent input image signal is not the false-contour-generating image signal, and wherein, whether said at least the second false contour reducing process is performed is decided based on a detection result on a preceding image signal by the specific color false-contour generating image signal detector.

28. A method for reducing an occurrence of a false contour on a display screen of a display device, said method comprising:

detecting an image signal which will generate a false contour, among input image signals to provide a false-contour-generating image signal;

detecting a signal which has a specific color in a specific color range, among the input image signals, to provide a specific color image signal; and performing a first false contour reducing process on a specific color false-contour-generating image signal, so as to reduce the false contour, wherein the specific color false-contour-generating image signal comprises an image signal which qualifies for both the false-contour-generating image signal and the specific color image signal, wherein the method further comprises determining that the input image signals comprise the false-contour-generating image signal when at least one color image signal among a plurality of color image signals in the input image signals falls within a predetermined gradation range and a pixel corresponding to such color image signal continuously exists over a predetermined area on the display screen in a single frame, and delaying, by one through m fields, introduction of the specific color false-contour-generating image signal, wherein at least a second false contour reducing process is performed when the specific color false-contour-generating image signal is introduced from at least one of a first through mth field delay units, thereby performing said at least the second false contour reducing process on those input image signals which are introduced later than the specific color false-contour-generating image signals and which are used in the display device at same display screen locations as the specific color false-contour-generating image signals, wherein said delaying is performed by the first through mth field delay units located between a specific color false-contour generating image signal detector and a false-contour reduction unit, even if a subsequent input image signal is not the false-contour-generating image signal, and wherein, whether said at least the second false contour reducing process is performed is decided based on a detection result on a preceding image signal by the specific color false-contour generating image signal detector.

29. A method for reducing an occurrence of a false contour on a display screen of a display device, said method comprising:

detecting image signals which have a specific color in a specific color range, among input image signals, to provide specific color image signals;

detecting a signal which will generate a false contour, among the specific color image signals to provide a specific color false-contour-generating image signal;

performing a first false contour reducing process on the specific color false-contour-generating image signal, so as to reduce the false contour;

determining that the input image signals comprise a false-contour-generating image signal when at least one color image signal among a plurality of color image signals in the input image signals falls within a predetermined gradation range and a pixel corresponding to such color image signal continuously exists over a predetermined area on the display screen in a single frame; and delaying, by one through m fields, introduction of the specific color false-contour-generating image signal, wherein at least a second false contour reducing process is performed when the specific color false-contour-generating image signal is introduced from at least one of a first through mth field delay units, thereby performing said at least the second false contour reducing process on those input image signals which are introduced later than the specific color false-contour-generating image signals and which are used in the display device at same display screen locations as the specific color false-contour-generating image signals, and wherein said delaying is performed by the first through mth field delay units located between a specific color false-contour generating image signal detector and a false-contour reduction unit, even if a subsequent input image signal is not the false-contour-generating image signal, and wherein, whether said at least the second false contour reducing process is performed is decided based on a detection result on a preceding image signal by the specific color false-contour generating image signal detector.

* * * * *